US007772565B2

(12) United States Patent
Wilson

(10) Patent No.: US 7,772,565 B2
(45) Date of Patent: Aug. 10, 2010

(54) RADIATION-SHIELDING ASSEMBLY HAVING CONTAINER LOCATION FEATURE

(75) Inventor: David W. Wilson, Loveland, OH (US)

(73) Assignee: Mallinckrodt Inc., Hazelwood, MO (US)

( * ) Notice: Subject to any disclaimer, the term of this patent is extended or adjusted under 35 U.S.C. 154(b) by 423 days.

(21) Appl. No.: 12/063,452

(22) PCT Filed: Aug. 11, 2006

(86) PCT No.: PCT/US2006/031398

§ 371 (c)(1),
(2), (4) Date: Feb. 11, 2008

(87) PCT Pub. No.: WO2007/021947

PCT Pub. Date: Feb. 22, 2007

(65) Prior Publication Data

US 2008/0185532 A1 Aug. 7, 2008

(51) Int. Cl.
*G21F 5/00* (2006.01)
*G21F 5/02* (2006.01)
*B65D 85/20* (2006.01)

(52) U.S. Cl. ..... 250/428; 250/432 R; 250/436; 250/506.1; 376/272

(58) Field of Classification Search ..... 250/428, 250/432 R, 433, 436, 496.1, 497.1, 506.1, 250/515.1, 507.1; 376/260, 261, 263, 264, 376/272, 328; 588/1, 20; 206/446
See application file for complete search history.

(56) References Cited

U.S. PATENT DOCUMENTS

| | | | | |
|---|---|---|---|---|
| 3,256,441 | A | 6/1966 | Grasty | |
| 3,428,281 | A | 2/1969 | Karp | |
| 3,531,644 | A | 9/1970 | Koster | |
| 3,673,411 | A | 6/1972 | Glasser | |
| 3,845,963 | A | 11/1974 | Price | |
| 3,882,315 | A * | 5/1975 | Soldan | 250/506.1 |
| 3,971,955 | A | 7/1976 | Heyer et al. | |
| 4,092,546 | A | 5/1978 | Larrabee | |
| 4,482,520 | A * | 11/1984 | Randazza | 376/261 |
| 4,634,873 | A | 1/1987 | Bezer et al. | |
| 4,788,438 | A | 11/1988 | Evers | |
| 5,396,526 | A * | 3/1995 | Ohuchi et al. | 376/261 |
| 5,429,614 | A | 7/1995 | Fowles et al. | |
| 5,552,612 | A * | 9/1996 | Katayama et al. | 250/506.1 |
| 6,213,994 | B1 | 4/2001 | Jansen et al. | |
| 6,501,813 | B1 * | 12/2002 | Soma et al. | 376/262 |
| 2004/0249235 | A1 | 12/2004 | Connell et al. | |
| 2006/0197031 | A1 * | 9/2006 | de Gheldere et al. | 250/432 R |
| 2008/0197302 | A1 * | 8/2008 | Fago et al. | 250/506.1 |

FOREIGN PATENT DOCUMENTS

| | | |
|---|---|---|
| GB | 958812 | 5/1964 |
| JP | 11-152161 | 6/1999 |

* cited by examiner

*Primary Examiner*—Bernard E Souw

(57) ABSTRACT

A radiation-shielding assembly can contain any of multiple containers of different sizes in a predetermined, fixed location within the assembly. A clamping system in of the assembly is able to clamp any of the containers so that they are held in the same fixed location within the assembly. The containers, regardless of size, are always located in the desired position within the shield. The positive location is achieved with out the use of separate components not attached to the assembly.

24 Claims, 8 Drawing Sheets

RADIATION-SHIELDING ASSEMBLY HAVING CONTAINER LOCATION FEATURE

FIELD OF THE INVENTION

The present invention relates generally to radiation-shielding devices for radioactive materials and, more particularly, to a radiation-shielding assembly that positively locates a container of radioactive material within the assembly.

BACKGROUND

Nuclear medicine is a branch of medicine that uses radioactive materials (e.g., radioisotopes) for various research, diagnostic and therapeutic applications. Radiopharmacies produce various radiopharmaceuticals (i.e., radioactive pharmaceuticals) by combining one or more radioactive materials with other materials to adapt the radioactive materials for use in a particular medical procedure.

For example, radioisotope generators may be used to obtain a solution comprising a daughter radioisotope (e.g., Technetium-99m) from a parent radioisotope (e.g., Molybdenum-99) which produces the daughter radioisotope by radioactive decay. A radioisotope generator may include a column containing the parent radioisotope adsorbed on a carrier medium. The carrier medium (e.g., alumina) has a relatively higher affinity for the parent radioisotope than the daughter radioisotope. As the parent radioisotope decays, a quantity of the desired daughter radioisotope is produced. To obtain the desired daughter radioisotope, a suitable eluant (e.g., a sterile saline solution) can be passed through the column to elute the daughter radioisotope from the carrier. The resulting eluate contains the daughter radioisotope (e.g., in the form of a dissolved salt), which makes the eluate a useful material for preparation of radiopharmaceuticals. For example, the eluate may be used as the source of a radioisotope in a solution adapted for intravenous administration to a patient for any of a variety of diagnostic and/or therapeutic procedures.

In one method of obtaining a quantity of the eluate from the generator, an evacuated container (e.g., an elution vial) may be connected to the generator at a tapping point. For example, a hollow needle on the generator can be used to pierce a septum of an evacuated container to establish fluid communication between the elution vial and the generator column. The partial vacuum of the container can draw eluant from an eluant reservoir through the column and into the vial, thereby eluting the daughter radioisotope from the column. The container may be contained in an elution shield, which is a radiation-shielding device used to shield workers from radiation emitted by the eluate after it is received in the container from the generator.

The same generator may be used to fill a number of containers before the radioisotopes in the column are spent. The volume of eluate needed at any time may vary depending on the number of prescriptions that need to be filled by the radiopharmacy and/or the remaining concentration of radioisotopes in the generator column. One way to vary the amount of eluate drawn from the column is to vary the volume of evacuated containers used to receive the eluate. For example, container volumes ranging from about 5 mL to about 30 mL are common and standard containers having volumes of 5 mL, 10 mL, or 20 mL are currently used in the industry. A container having a desired volume may be selected to facilitate dispensing of a corresponding amount of eluate from the generator column.

Unfortunately, the use of multiple different sizes of containers is associated with significant disadvantages. Hindering substantial movement of the container in the shield is desirable to avoid damage to the container, the shield, and/or the generator. Moreover, some feel it desirable that the position of the container in the shield be consistent from one container to the next so that the container can be accessed in a consistent fashion. One solution would be to have a dedicated shield for each size of container. However, cost and convenience tend to promote the use of a single shield capable of accommodating differently sized containers (one at a time).

A radiopharmacy may attempt to manipulate a conventional shielding device so that it can be used with containers of various sizes. One solution that has been practiced is to keep a variety of different spacers on hand that may be inserted into shielding devices to temporarily occupy extra space in the radiation-shielding devices when smaller containers are being used. This may add complexity and/or increase the risk of confusion because the spacers can get mixed up, lost, broken, and/or used with the wrong container. Some conventional spacers surround the sides of the containers in the shielding-devices, which is where labels may be attached to the containers. Accordingly, the spacers may mar the labels and/or contact adhesives used to attach the labels to the container resultantly causing the spacers to stick to the sides of the container or otherwise gum up the radiation-shielding device. Thus, improved radiation-shielding assemblies and methods of handling differently sized containers for containing one or more radioisotopes would be desirable.

SUMMARY

One aspect of the present invention is directed to a radiation-shielding assembly for holding an eluate container. The assembly generally includes a body having a cavity for receiving the container at least partially defined therein, and an opening into the cavity. The body of the assembly includes a radiation-shielding material (e.g., lead, tungsten, etc.). A clamping system located at least in part in the cavity of the body can releasably hold the container at a predetermined position relative to the opening in the body.

Another aspect of the present invention is directed to a method of handling an eluate container. The container is placed in a cavity of a radiation-shielding body. The body includes an opening to the cavity. The container is held at a predetermined location relative to the opening by clamping the container in position after placing the container in the cavity.

Still another aspect of the present invention is directed to a radiation-shielding assembly for housing a container of radioactive material. The assembly generally includes a body having an internal cavity for housing the container and a longitudinal axis. A clamping system can hold the container in the cavity by exerting a compressive force on the container transverse to the longitudinal axis of the cavity.

Yet another aspect of the present invention is directed to a method of housing a container of radioactive material in a radiation-shielding assembly. This method generally includes placing the container in an internal cavity of a body. The cavity has a longitudinal axis. The container is held in the cavity by exerting a force on the container transverse to the longitudinal axis of the cavity (e.g., with a clamping system).

In another aspect, an assembly of the present invention generally includes a body of a radiation-shielding material having a cavity for receiving the container defined at least in part inside the body. The cavity has a longitudinal axis. The body includes an opening into the cavity. A detent at least partially in the cavity is moveable between a hold position, in which the detent holds the container adjacent the opening, and a release position, in which the detent is adapted to release the container. Movement of the detent between the hold position and the release position includes movement of the detent transverse to the longitudinal axis of the cavity.

A still further aspect of the present invention is directed to a method for holding a container of radioactive material in a radiation-shielding assembly. The method generally includes placing the container in a cavity in a radiation-shielding body so the container is adjacent an opening in the body to the cavity. The cavity has a longitudinal axis. The container is held adjacent the opening by moving a detent from a release position in which the detent permits movement of the container away from the opening to a hold position in which the detent inhibits movement of the container away from the opening. Moving the detent includes movement of the detent transverse to the longitudinal axis of the cavity. In some embodiments, the detent may be locked into the hold position to inhibit movement of the container. In such embodiments, the detent may be required to be unlocked (e.g., by activating an appropriate release) so that the container may be removed from the assembly.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the aspects of the present invention.

BRIEF DESCRIPTION OF THE DRAWINGS

Corresponding reference characters indicate corresponding parts throughout the several views of the drawings.

DETAILED DESCRIPTION

Figure 1:
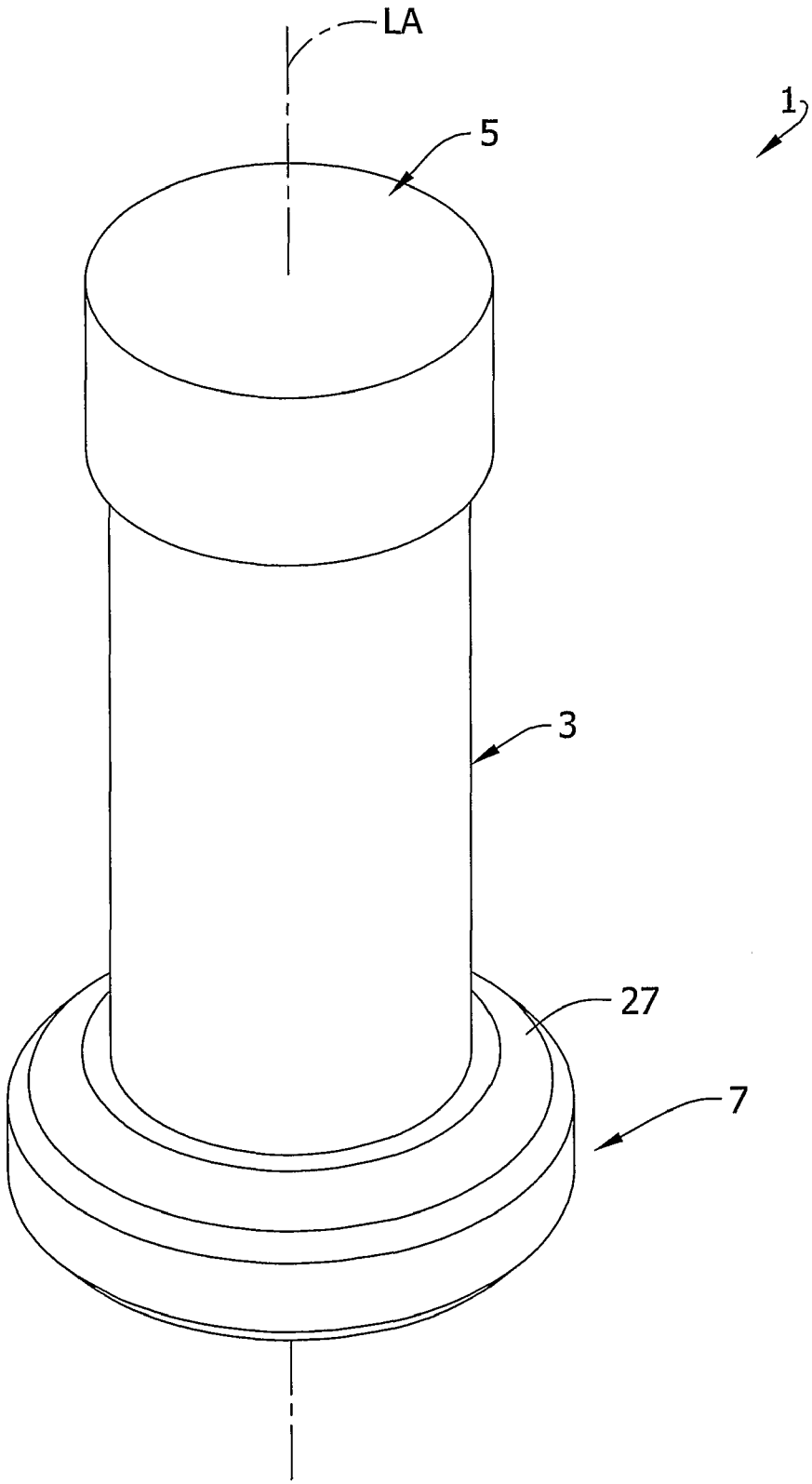
FIG. 1 is a perspective of a radiation-shielding assembly of the present invention.

Referring now to the drawings, first to FIGS. 1-4 in particular, one embodiment of a radiation-shielding assembly of the present invention is shown as a rear-loaded radioisotope elution shield assembly, generally designated at 1. The assembly may enclose a container (e.g., an elution vial V1) containing a radioisotope (e.g., Technetium-99m) that emits radiation in a radiation-shielded cavity in the assembly, thereby limiting escape of radiation emitted by the radioisotope from the assembly. Thus, the assembly 1 may be used to limit the radiation exposure to workers handling one or more radioisotopes or other radioactive material. The assembly 1 may be used as a dispensing shield without departing from the scope of the present invention.

Figure 9:
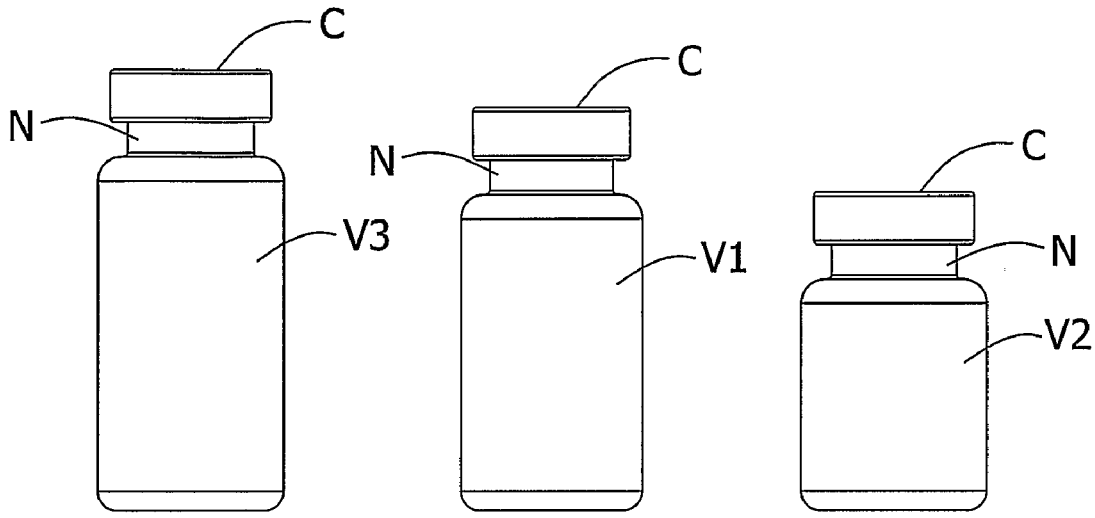
FIG. 9 is a perspective showing three elution vials that can be used with the assembly.

The illustrated assembly 1 generally has a body 3, a cap 5, and a base 7 (the reference numbers indicating their subjects generally). The assembly 1 further includes an annular spring detent actuator generally indicated at 9 (broadly, "an actuator") and two spring detents generally indicated at 11. It will be understood that the number of detents may be other than two, and the detents do not have to be a "spring" (i.e., the detent(s) may be rigid rather than resilient) within the scope of the present invention. The construction and use of the detent actuator 9 and detents 11 will be described in more detail hereinafter. The body 3 defines a cavity 13 adapted to receive the vial V1. The vial may be of any suitable size such as 10 ml. The assembly 1 of the present invention can work with containers of different sizes, such as the set of vials indicated at V1, V2 and V3, respectively in FIG. 9. The vials V2 and V3 can be of any suitable size such as 5 ml and 20 ml, respectively. The number of vials in the set and their relative sizes can be other than described without departing from the scope of the present invention. In the illustrated embodiment, the vials V1, V2, V3 have three different heights.

The cavity 13 in the body 3 extends lengthwise completely through the body, opening at a rear end opening 17 and a front end opening 19. However, it is envisioned that the body 3 could be open at only one end. The shape of the body 3 is generally tubular with a neck portion 21 adjacent to the front end opening 19 that receives the detent actuator 9 and the cap 5. It will be understood that the shape of the body 3 could be different (e.g., polygonal) within the scope of the present invention. The body 3 can be constructed to limit escape of radiation emitted in the cavity 13 from the assembly 1 through the body. For example, in some embodiments the body 3 is made of a radiation-shielding material (e.g., lead, tungsten, depleted uranium and/or another dense material). The radiation-shielding material can be in the form of one or more layers (not shown). Some or all of the radiation-shielding material can be in the form of substrate impregnated with one or more radiation-shielding materials (e.g., a moldable tungsten impregnated plastic). Those skilled in the art will know how to design the body 3 to include a sufficient amount of one or more radiation-shielding materials in view of the amount and kind of radiation expected to be emitted in the cavity 13 and the applicable tolerance for radiation exposure to limit the amount of radiation that escapes the assembly 1 through the body 3 to a desired level.

The rear end opening 17 may be sized greater than the front end opening 19. For example, the rear end opening 17 is sized so that the entire vial V1 (or any of vials V1, V2 and V3) can be received into the cavity 13 in the body 3 through the rear end opening, and the front end opening 19 is sized to prevent passage of the vial V1 (and vials V2 and V3) out of the cavity and yet permit passage of at least a tip of a needle (not shown) therethrough (e.g., a needle on a tapping point of a radioisotope generator). The front end opening 19 provides access for the needle to a pierceable septum (not shown) of the vial V1 received in the cavity 13.

Figure 2:
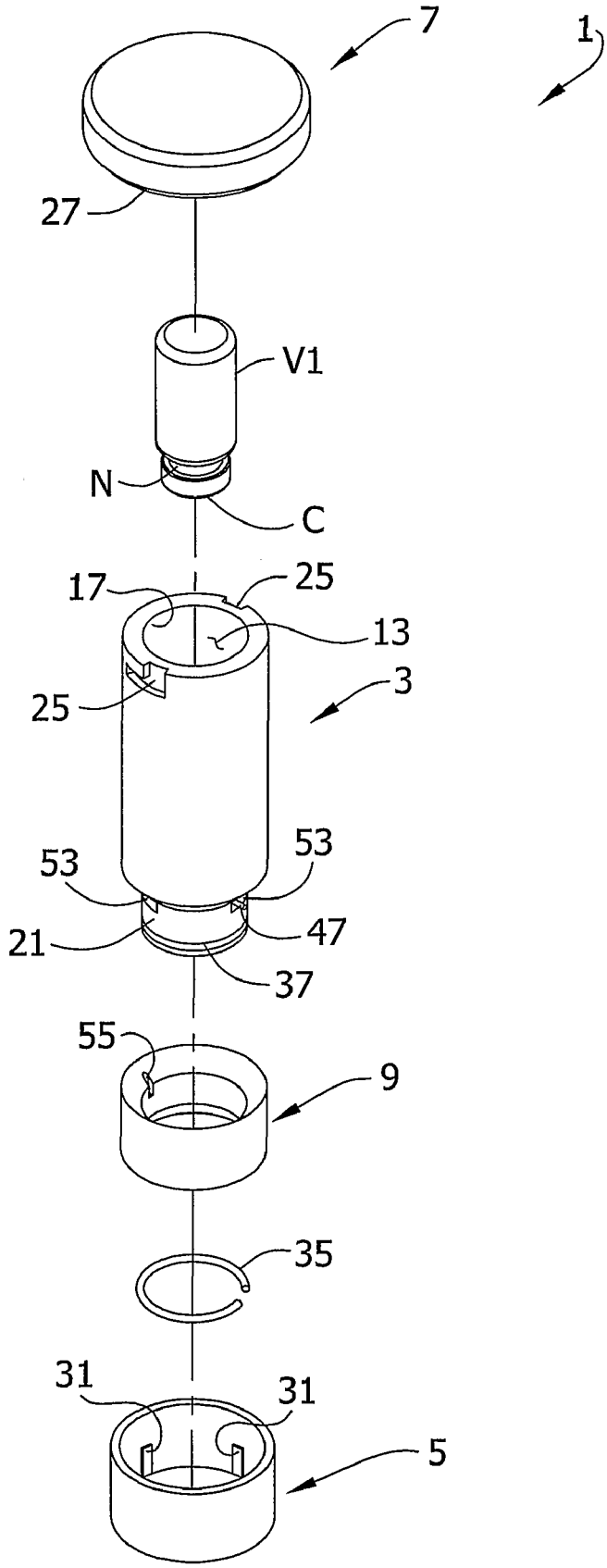
FIG. 2 is an exploded perspective thereof.

The base 7 can be attached to the body 3 so as to cover the rear end opening 17. In the illustrated embodiment, the base 7 is connected to the body 3 by a bayonet connection. Other forms of releasable connection may be used without departing from the scope of the present invention. More specifically, as to the bayonet connection, the body 3 includes two generally L-shaped slots 25 located on diametrically opposite sides of the rear end opening 17 (FIG. 2). The base 7 has a reduced diameter cup portion 27 sized to receive a margin of the body near the rear end opening 17 (FIG. 1). The cup portion 27 has a pair of lugs (not shown) on diametrically opposite sides of an internal diameter of the cup portion. The lugs can be received in respective ones of the slots 25. By twisting the base 7 relative to the body 3 after the lugs are received in the slots 25, a secure connection of the base to the body can be achieved by the lugs moving into narrower, circumferentially extending portions of the slots. To release the connection, the base 7 can be turned in the opposite direction to align the lugs with wider, generally axially extending portions of the slots 25. The base 7 can then be separated from the body 3 to open the rear end opening 17 such as for insertion or removal of the vial V1.

In some embodiments, the base 7 is made of a material that blocks radiation that would otherwise escape the cavity 13 through the rear end opening 17. Suitable radiation-shielding materials and composites may be used, such as described above for the body 3. As used in the appended claims, "radiation-shielding material" refers to both materials that are almost entirely made of a radiation-shielding substance (e.g., lead), and to materials that are composites of radiation-shielding substances and other substances that may be, by themselves, transparent to radiation. It is envisioned that a base may be made so that only a portion of the base is capable of shielding radiation while another portion may be made of a different (e.g., lighter weight) material that is transparent to such radiation. For example, only the portion of the base 7 that covers the rear end opening 17 may be made of radiation-shielding material.

Figure 3:
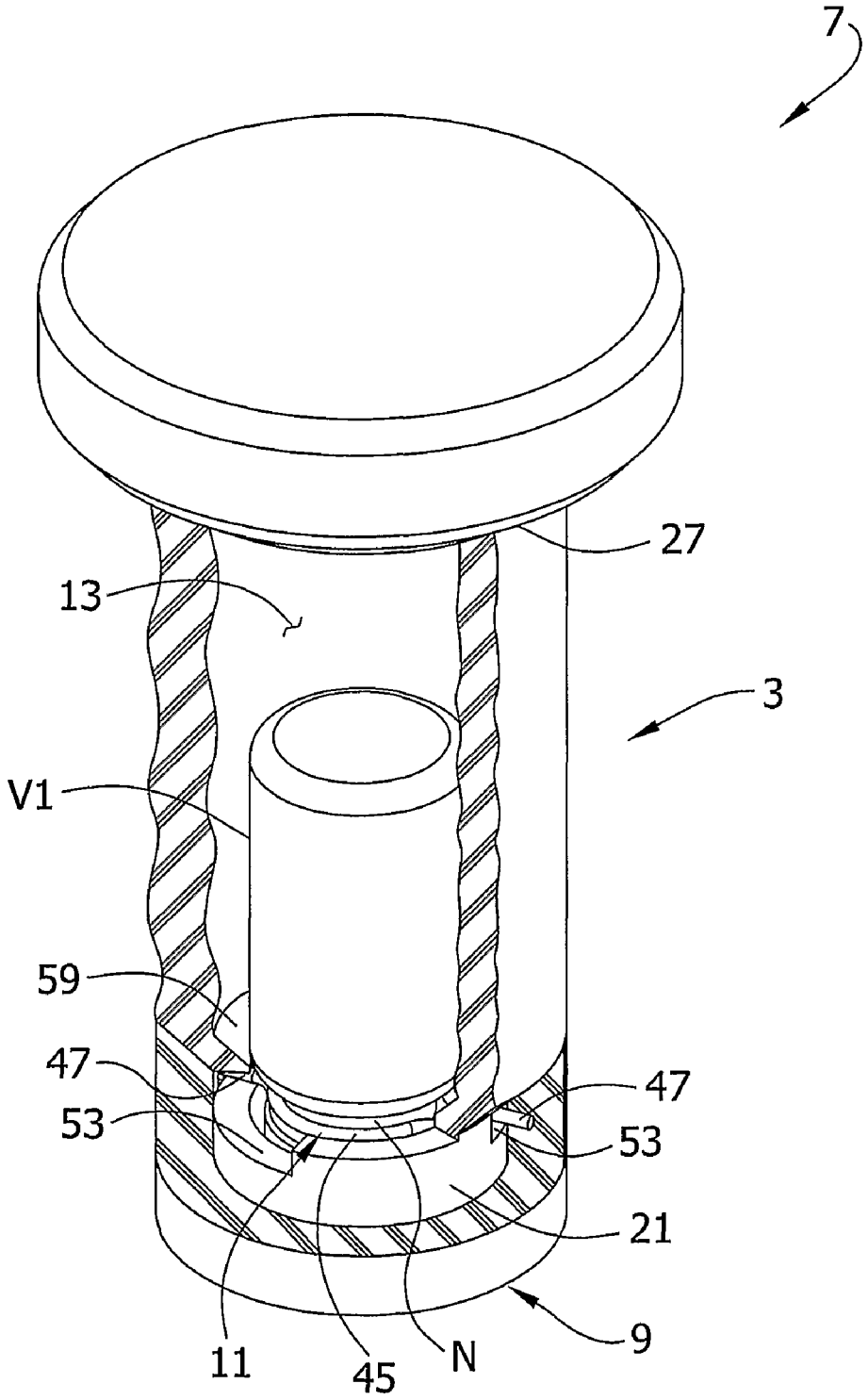
FIG. 3 is perspective of the assembly similar to FIG. 1, but with the assembly inverted, a cap of the assembly removed and parts broken away to show internal construction.

The cap 5 may be removed from the assembly 1 as shown in FIGS. 2 and 3 to expose the front end opening 19 so that the vial V1 in the cavity 13 of the assembly can be fluidly interconnected with a radioisotope generator through the front end opening. Incidentally, "fluidly interconnected" or the like refers to a joining of a first component to a second component or to one or more components which may be connected with the second component, or a joining of the first component to part of a system that includes the second component so that a substance (e.g., an eluant and/or eluate) may pass (e.g., flow) at least one direction between the first and second components.

There are a number of ways to design a cap to be releasably attachable to the body 3. The cap 5 shown in the drawings, for example, is formed with plural ribs 31 (only two are shown) that are spaced circumferentially along an interior diameter of the cap (FIG. 2). These ribs 31 can engage an exterior surface of the detent actuator 9 providing an interference fit between the cap 5 and the actuator that is able to hold the cap on the actuator, and hence on the body 3. The connection of the detent actuator 9 to the body 3 will be described in more detail hereinafter. It is possible to release the connection between the cap 5 and the actuator 9 by manually applying a force to pull the cap off of the actuator. It will be understood that there are other ways to releasably connect a cap to a body, including those in which the cap directly engages the body. Moreover, there are several forms of connection that could be used to secure the cap to the body. For instance, a cap might include a magnetic portion that attracts a body, or a magnetic portion on the body could attract the cap. A cap and/or a body may be equipped with detents, snaps and/or friction fitting elements or other fasteners that are operable to releasably attach the cap to the body without departing from the scope of the invention.

The cap 5 may be constructed to limit escape of radiation emitted in the cavity 13 from the assembly 1 through the front end opening 19 when the cap is releasably attached to the body 3. For example, the cap 5 may include one or more radiation-shielding materials (not shown), as described above. Those skilled in the art will be able to design the cap 5 to include a sufficient amount of one or more radiation-shielding material to achieve the desired level of radiation shielding. In order to reduce costs, radiation-shielding materials may be positioned at the center of the cap 5 (e.g., in registration with the front end opening 19 when the cap is positioned relative to the body as shown in FIG. 1), and the outer circumference of the cap may be made from less expensive and/or lighter-weight non-radiation-shielding materials, but this is not required for practice of the present invention.

Figure 8:
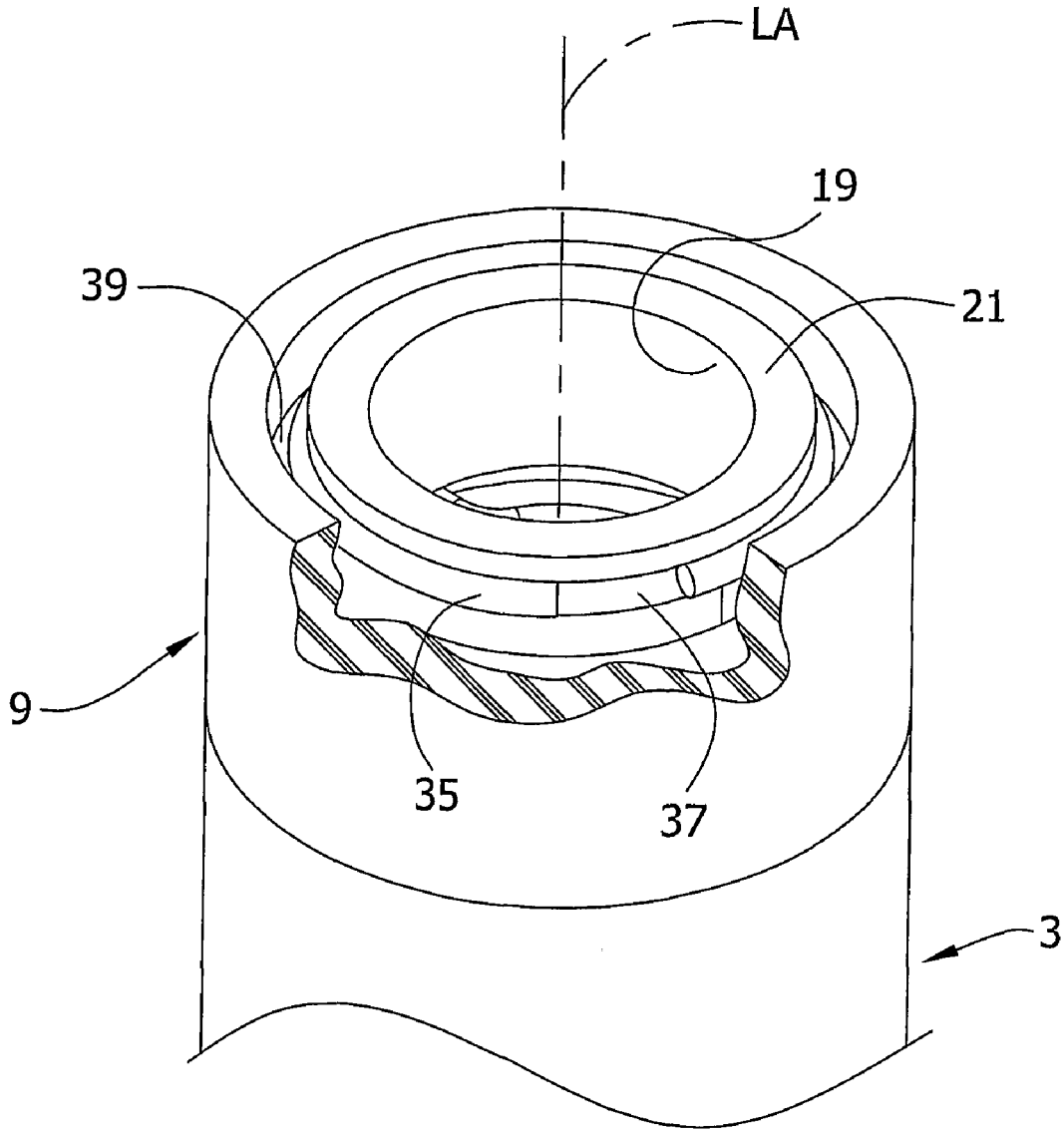
FIG. 8 is an enlarged, fragmentary perspective of an upper end of the assembly as oriented in FIG. 1 with the cap removed and parts broken away to show internal construction.

In the illustrated embodiment, the detent actuator 9 and detents 11 form part of a clamping system, but it will be appreciated that the clamping system may include additional or different components within the scope of the present invention. The detent actuator 9 is capable of releasable attachment to the body 3 by way of a resilient retaining ring 35. The retaining ring is split to facilitate expansion of the ring 35. The actuator 9 may be received on the neck portion 21 of the body 3. The retaining ring 35 has a relaxed diameter that is less than the diameter of the body 3 (and less than the front end opening 19 in some embodiments). By expanding the ring 35, it can be received around the front end of the body 3 and into a circumferential groove 37 in the body (see FIG. 8). The actuator 9 has a counterbore 39 that allows the ring 35 to be received in the actuator. The retaining ring 35 is captured in the groove 37 and bears against the actuator 9 in the counterbore 39 to hold the actuator on the body 3. The connection of the actuator 9 to the body 3 is such that the actuator can be turned about a longitudinal axis LA of the body while remaining connected to the body. The cap 5 can be fitted over the actuator 9 on the neck portion 21, as described previously. In the illustrated embodiment, the longitudinal axis LA of the body 3 coincides with a longitudinal axis of the cavity 13.

Figure 4:
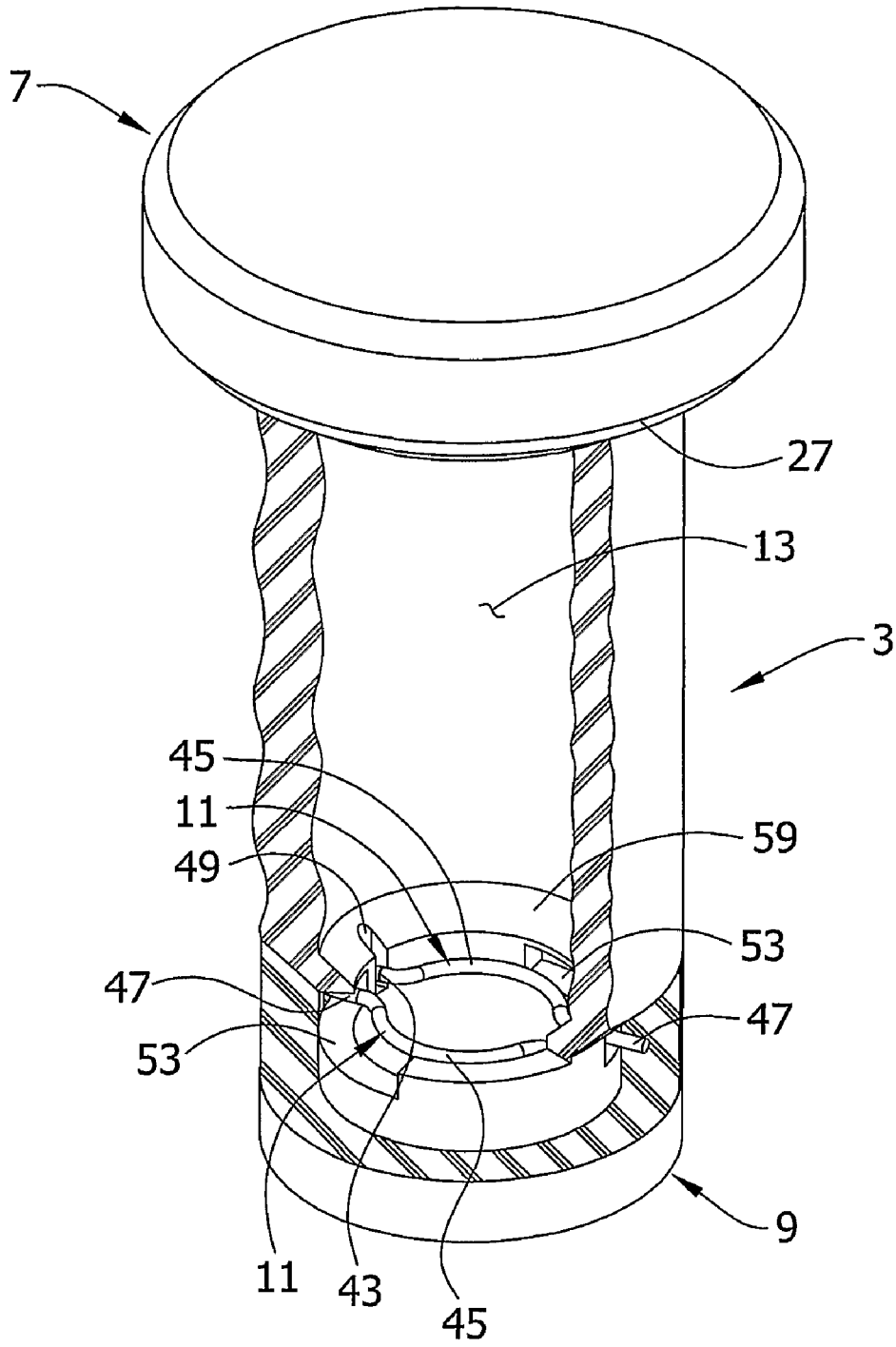
FIG. 4 is the perspective of FIG. 3, but with the vial shown in the assembly of FIG. 3 removed.
Figure 5:
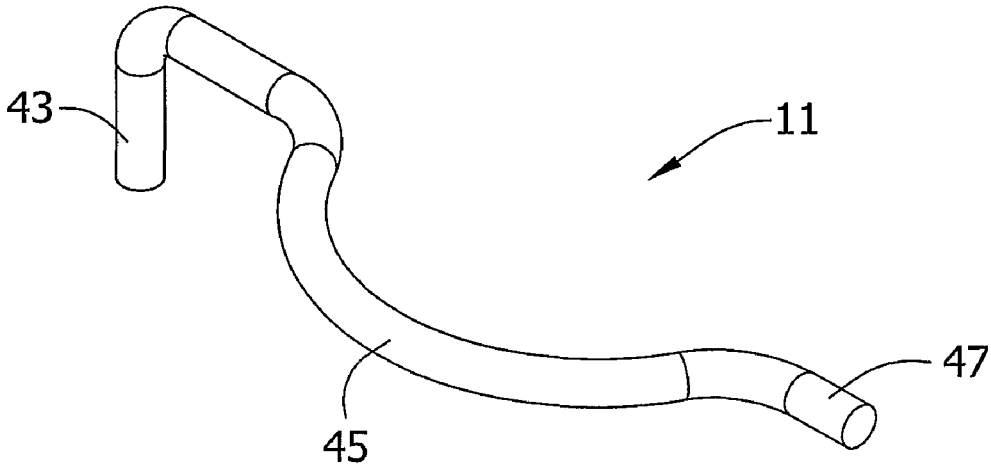
FIG. 5 is an enlarged perspective of a spring detent of the assembly of FIG. 1.

As shown in FIG. 5, each of the detents 11 of the illustrated embodiment is a wire formed to have a roughly L-shaped first end portion 43, a curved middle portion 45 and a projecting second end portion 47. The detents are not formed as one piece or integral with each other in the illustrated embodiment, but may be so within the scope of the present invention. The curved middle portion 45 may generally correspond to the shape of a circumferential segment of a neck N of the vial V1, and in one position engages a portion of the vial neck (see FIG. 3). The detents 11 are each mounted in the neck portion 21 of the body 3. The first end portion 43 of each detent 11 is received in a respective one of two holes 49 (FIG. 4, only one is shown) formed in the body within the cavity 13 so as to hold the detent in a position extending across the cavity. The reception of the first end portion 43 in the hole is such that the detent 11 is held in a manner in which it is substantially prevented from free rotation about an axis substantially parallel to the longitudinal axis LA of the body 3. The second end portion 47 of each detent 11 projects through a respective one of two elongate windows 53 located in the side of the neck portion 21 of the body 3. When the actuator 9 is received on the neck portion 21, the second end portions 47 of the detents 11 are received in respective recesses 55 in the actuator located along an inner diameter of the actuator (see FIG. 4). In this way, the second end portions 47 are captured in the recesses 55 for movement with the actuator 9 when it is rotated about the longitudinal axis LA of the body 3.

In a hold position of the clamping system shown in FIGS. 3 and 4, the curved middle portions 45 are relatively closer together and can engage the neck N of the vial V1 on opposite sides to grip the vial and hold it in generally aligned position with the front end opening 19 of the body 3. As may be seen in FIG. 3, the cavity 13 is significantly longer than the vial V1. Absent the detents 11, the vial V1 would not be fixed relative to the front end opening 19 and could move around inside the cavity 13 depending upon the orientation of the elution shield assembly 1. The detents 11 are able to hold any of the vials V1, V2, V3 in a predetermined location within the cavity 13. More specifically, the vials V1, V2, V3 can be held so that a septum (not shown) in the neck N of each vial is located in the same predetermined location relative to the front end opening 19 for being accessed by the needle of the radioisotope generator (or other needle not associated with a generator).

The clamping system can be actuated to move from the hold position to a release position in which the curved middle portions 45 of the detents 11 are relatively farther apart, providing a larger passage between the detents than in the hold position. This allows the vial V1 (or either of vials V2 and V3) to be received between the detents 11 and to be released from between the detents. In the illustrated embodiment, the "release position" and the "hold position" may be considered first and second states (respectively) of the clamping system. The detents 11 have no more than a weaker grip on the vial neck N in the release position that in the hold position. In other words the detents 11 could remain in contact with the vial V1 in the release position, but would not act as strongly to retain the position of the vial as in the hold position. It is also possible that in the hold position the detents 11 may not at all times be in engagement with the vial V1.

Figure 6:
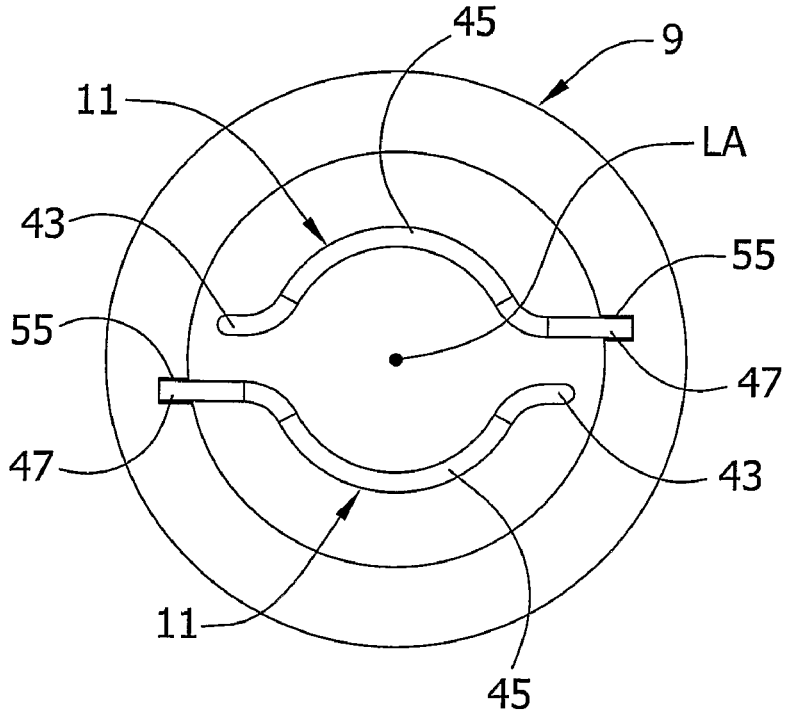
FIG. 6 is a schematic view taken generally as indicated by line 6-6 of FIG. 4 and showing detents of the assembly in a hold position.
Figure 7:
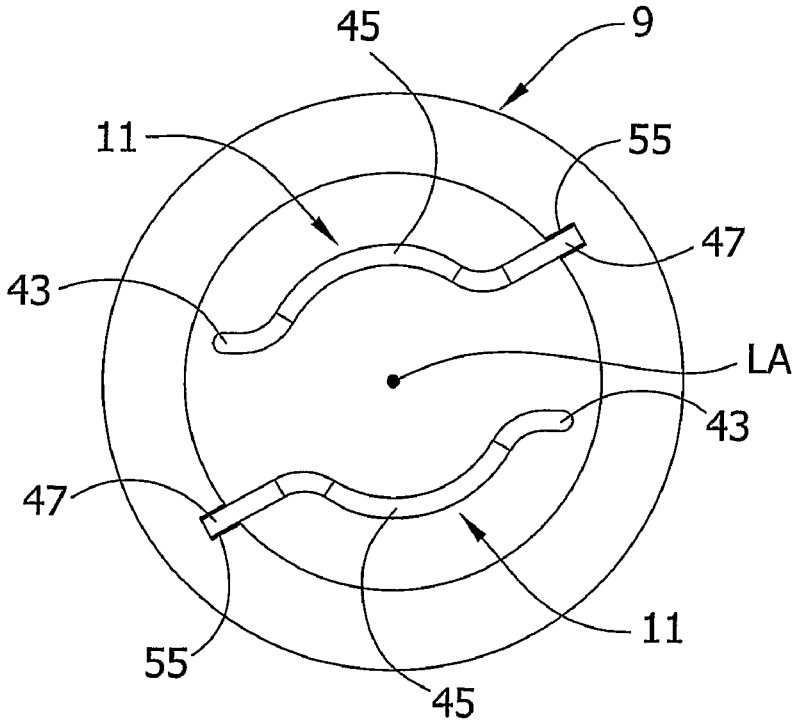
FIG. 7 is a schematic view similar to FIG. 6 but showing the detents in a release position.

FIGS. 6 and 7 schematically illustrate the detents 11 as mounted on the body 3 (although for clarity the body has been removed), and the detent actuator 9. The first end portions 43 of the detents 11 are illustrated as fixed (as they would be when received in the body 3). Rotation of the detent actuator 9 from the hold position illustrated in FIG. 6 counterclockwise to the release position illustrated in FIG. 7 moves the second end portions 47 of the detents I1 along arcs that are generally transverse to the longitudinal axis LA of the body 3. The first end portions 43 are substantially held in the holes 49 against pivoting with the movement of the second end portions 47. Thus, the detents 11 are resiliently deformed away from their relaxed configurations to move so that the middle portions 45 are farther apart. Generally speaking, the middle portions 45 are separated by a distance greater than the diameter of the vial V1 at the neck N, allowing the neck N and cap C of the vial V1 to pass into or out of the space between the detents 11. Stated another way, a passage area defined generally between the middle portions 45 of the detents 11 is larger in the release position that in the hold position.

When the manual force holding the detent actuator 9 in the release position of FIG. 7 is released, the resiliency of the detents 11 rotates the actuator back to the hold position (FIG. 6). Again the movement is generally transverse to the longitudinal axis LA of the body 3. If the neck N of the vial V1 is located between the middle portions 45 of the detents 11, they will engage and hold the vial as described previously. In one embodiment, the detents 11 do not return to their relaxed position when they engage the neck N. Accordingly, the detents 11 remain slightly deformed and apply a resilient, compressive retaining force against the neck N. Although the actuator 9 of the illustrated embodiment is shown as operating by rotation relative to the body 3 in directions generally transverse to the longitudinal axis LA, it is envisioned that an actuator (not shown) that operates through linear or other motion relative to the body could be used. Still further, an actuator could be located away from the front end opening 19 of the body 3. For instance, actuation of the detents 11 could occur through the manipulation of a base (not shown.

Having described the construction of the illustrated embodiment of the present invention, one exemplary manner of using the elution shield assembly 1 will be described. One of the vials (e.g., vial V1) to be filled with eluate including a radioisotope is selected. The base 7 of the assembly is removed from the body 3 by twisting the base to release the bayonet connection and separating the base from the body 3 to expose the rear end opening 17 of the body. The vial V1 is inserted, neck N first, through the rear end opening 17 into the cavity 13. The body 3 has been previously positioned in the inverted position (e.g., as in FIGS. 3 and 4) so that the vial V1 naturally moves toward the front end opening 19 of the cavity 13. The cavity 13 is shaped (e.g., angled) at a transition 59 to the neck portion 21 of the body 3 so that the neck N of the vial V1 is smoothly guided into the neck portion. The cap 5 would not generally be connected to the body 3 at this time.

Turning the detent actuator 9 moves the detents 11 from the hold position (FIG. 6) to the release position (FIG. 7). This allows the neck N of the vial V1 to pass between the curved middle portions 45 of the detents 11. Upon release of the actuator 9, the detents 11 pivot back to the hold position, gripping the neck N of the vial V1 between them. The vial V1 is now retained in position relative to the front end opening 19 of the body 3. The base 7 is reattached to the body 3 to close the rear end opening 17 of the body. The elution shield assembly is attached to a radioisotope generator by inserting a needle through the front end opening 19, penetrating the septum of the vial V1 and passing the needle into the vial. Typically, the vial V1 has previously been evacuated so that it exerts a vacuum through the generator needle drawing eluate containing the radioisotope into the vial. The vial V1 may be sized so that the amount of liquid drawn into the vial is a predetermined amount, for example about 10 ml.

The elution shield assembly 1 can then be disconnected from the radioisotope generator. The septum of the vial V1 reseals upon removal of the needle so that the liquid does not leak out of the vial V1. The cap 5 can be pushed onto the body 3 over the detent actuator 9. The ribs 31 on the inner diameter of the cap 5 engage the actuator 9 and connect the cap to the assembly. The vial V1 filled with a radioactive substance can now be transported or stored in the radiation shield.

When the liquid in the vial V1 has been dispensed, or if it is desired to remove the vial for any other reason, the base 7 may be removed from the body 3 (e.g., by relieving the bayonet-type interconnection of the base 7 and the body 3). The detent actuator 9 may be turned so that the detents I1 move apart to release their hold on the neck N of the vial V1. The vial can be slid out of the cavity 13 by turning the body 3 more to an upright position. The elution shield assembly 1 can be used for another vial of the same size, or used with one of the vials V2, V3 of the other sizes. Regardless of the height of the particular vial chosen, the detents 11 can hold the vial so that its septum is in the same place in the cavity 13 relative to the front end opening 19 as the septum of any other vial would be. Moreover, the detents 11 hold the vial from moving around in the body cavity 13.

In view of the above, the present invention may be characterized by some as advantageously improving the state of the art.

When introducing elements of the present invention or various embodiments thereof, the articles "a", "an", "the", and "said" are intended to mean that there are one or more of the elements. The terms "comprising", "including", and "having" are intended to be inclusive and mean that there may be additional elements other than the listed elements. Moreover, the use of "top" and "bottom", "front" and "rear", "above" and "below" and variations of these and other terms of orientation is made for convenience, but does not require any particular orientation of the components.

As various changes could be made in the above systems and methods without departing from the scope of the invention, it is intended that all matter contained in the above description and shown in the accompanying drawings shall be interpreted as illustrative and not in a limiting sense.

What is claimed is:

1. A radiation-shielding assembly for holding an eluate container, the assembly comprising:

a body having a cavity for receiving the container at least partially defined therein, the body defining an opening into the cavity, and the body including a radiation-shielding material; and a clamping system at least partially disposed in the cavity, the clamping system comprising a first detent projecting generally transversely within the cavity, the detent being operable to engage a neck of the container to releasably hold the container at a predetermined position relative to the opening.

2. A radiation-shielding assembly as in claim 1, wherein the clamping system is selectively adjustable from a first state in which the clamping system has no more than a relatively weaker grip on the container and a second state in which the clamping system has a relatively stronger grip on the container.

3. A radiation-shielding assembly as in claim 2, further comprising an actuator rotatable relative to the body about an axis extending generally lengthwise of the cavity, wherein adjustment of the clamping system between the first and second states is controlled by movement of the actuator relative to the body.

4. A radiation-shielding assembly as in claim 2, wherein the clamping system further comprises a second detent, the first and second detents at least partially defining a passage, at least one of the detents being moveable relative to the other of the detents, the detents being positioned relative to one another in the first state to define a relatively larger passage and being positioned relative to one another in the second state to define a relatively smaller passage.

5. A radiation-shielding assembly as in claim 1, wherein the opening is a first opening and the body also defines a second opening sized larger than the first opening, the assembly further comprising a base releasably attached to the body, the base being operable to limit escape of radiation emitted in the cavity from the assembly through the second opening when the base is attached to the body.

6. A radiation-shielding assembly as in claim 1, wherein the clamping system is located adjacent the opening.

7. A radiation-shielding assembly as in claim 1, wherein the predetermined position is at a center of the cavity aligned with the opening.

8. A method of handling an eluate container, the method comprising:

placing the container in a cavity defined in a radiation-shielding body having an opening to the cavity; and releasably holding the container at a predetermined location relative to the opening and at a predetermined position on the container by clamping the container at the predetermined position using a compressive force transverse to the longitudinal axis of the cavity after placing the container in the cavity.

9. A method as in claim 8 further comprising receiving the radioactive material in the container through the opening while the container is in the cavity.

10. A method as in claim 9, wherein receiving the radioactive material comprises receiving an eluate comprising a radioisotope from a radioisotope generator.

11. A method as in claim 8, wherein placing the container comprises placing the container in the cavity while the clamping system is in a first state in which the clamping system is operable to receive the container, and releasably holding the container comprises adjusting the clamping system to a second state in which the clamping system is operable to hold the container in a substantially fixed position in the cavity.

12. A method as in claim 11, wherein adjusting the clamping system comprises rotating an actuator mounted on the body relative to the body about an axis extending generally lengthwise of the cavity.

13. A method as in claim 11, wherein the clamping system comprises first and second detents, the detents being moveable relative to one another from a first state in which the detents define a first passage area and a second state in which the detents define a second passage area sized smaller than the first passage area, wherein adjusting the clamping system comprises moving the detents from their first state to their second state.

14. A method as in claim 13, wherein adjusting the clamping system comprises moving an actuator of the assembly relative to the body to move the detents from their first state to their second state.

15. A method as in claim 8, wherein the opening is a first opening and placing the container comprises transferring the container into the cavity through a second opening sized larger than the first opening, the method further comprising attaching a base to the body while the container is in the cavity, the base being operable to limit escape of radiation emitted in the cavity from the assembly through the second opening.

16. A method as in claim 8, wherein the container is a first container, the method further comprising:

removing the first container from the assembly;

placing a second container in the cavity, the second container having a different size than the first container;

using the clamping system hold the second container at a predetermined location relative to the opening; and receiving the radioactive material in the second container through the opening while the second container is in the cavity.

17. A radiation-shielding assembly for housing a container of radioactive material, the assembly comprising:

a body having an internal cavity for housing the container, the cavity having a longitudinal axis; and a clamping system carried by the body and projecting into the cavity to releasably hold the container in the cavity by exerting a resilient compressive force on the container transverse to the longitudinal axis of the cavity.

18. A radiation-shielding assembly as in claim 17, wherein the clamping system comprises a resilient detent operable to engage a neck of the container.

19. A method of housing a container of radioactive material in a radiation-shielding assembly, the method comprising:

placing the container in an internal cavity of a body, the cavity having a longitudinal axis; and moving an actuator associated with the body to cause an elongate detent projecting transversely within the cavity to exert a resilient force on the container transverse to the longitudinal axis of the cavity to hold the container in the cavity.

20. A method as in claim 19, wherein holding the container comprises exerting said force at a neck of the container.

21. A method as in claim 19, wherein holding the container comprises selectively adjusting a clamping system from a first state in which the clamping system has no more than a relatively weaker grip on the container and a second state in which the clamping system has a relatively stronger grip on the container, wherein adjusting the clamping system comprises moving the actuator mounted on the body to adjust the clamping system between the first and second states.

22. A method as in claim 19, wherein placing the container comprises inserting the container into the cavity through an opening in the body, the method further comprising releasably attaching a base to the body generally at the opening to at least partially enclose the container in the cavity.

23. A method as in claim 19, wherein holding the container comprises holding the container adjacent an opening into the cavity through the body.

24. A method for holding a container of radioactive material in a radiation-shielding assembly, the method comprising:

placing the container in a cavity in a radiation-shielding body so the container is adjacent an opening in the body to the cavity, the cavity having a longitudinal axis; and holding the container adjacent the opening by moving a detent from a release position in which the detent permits movement of the container away from the opening to a hold position in which the detent inhibits movement of the container away from the opening, wherein moving of the detent includes pivoting movement of the detent generally in a plane transverse to the longitudinal axis of the cavity.

* * * * *